US005759051A

United States Patent [19]

Cancellieri et al.

[11] Patent Number: 5,759,051

[45] Date of Patent: Jun. 2, 1998

[54] RACEWAY WITH TRACK MOUNTED ELECTRICAL RECEPTACLES RANDOMLY PLACED

[75] Inventors: Salvatore A. Cancellieri, Plainville; Wilfred R. Rogers, Bristol, both of Conn.

[73] Assignee: The Wiremold Company, West Hartford, Conn.

[21] Appl. No.: 736,365

[22] Filed: Oct. 23, 1996

[51] Int. Cl.[6] ..... H01R 25/00

[52] U.S. Cl. ..... 439/118; 113/121

[58] Field of Search ..... 439/110, 113, 439/114, 118–120, 121, 122

[56] References Cited

U.S. PATENT DOCUMENTS

| | | | |
|---|---|---|---|
| 3,081,442 | 3/1963 | Platz | 439/118 |
| 3,503,032 | 3/1970 | Routh et al. | 439/118 |
| 3,529,274 | 9/1970 | Routh | 439/118 |
| 5,582,520 | 12/1996 | Doudon | 439/122 |
| 5,603,621 | 2/1997 | Elmouchi | 439/119 |

*Primary Examiner*—J. J. Swann

*Attorney, Agent, or Firm*—McCormick, Paulding & Huber

[57] ABSTRACT

An extruded track or base has exposed conductor segments molded into the polymeric base. A socket defining adaptor is releasably secured to the base in any location there along by twisting it through only 45 degrees or less. The adaptor is assembled from a back plate that has cams designed to fit into slots provided in the base, and a cover portion that defines a socket for a thru prong plug. In a cavity defined by the cover and back plate fixed and flexible contacts provide electrical connection between the plug socket and the conductor segments in the track or base. Each plug prong is connected with an opposite conductor and the ground plug stud connects to a ground conductor in the base through a spring located at the axis of rotation for the adaptor during the twist locking of the adaptor onto the track.

5 Claims, 8 Drawing Sheets

RACEWAY WITH TRACK MOUNTED ELECTRICAL RECEPTACLES RANDOMLY PLACED

This invention relates generally to electrical power distribution systems, and deals more particularly with a raceway having a continuous track which is designed to receive electric outlets or receptacles at random locations.

BACKGROUND OF THE INVENTION

Extruded electrical tracks provided with conductors embedded in the extruded polymeric track material are known. See for example, Edmonson U.S. Pat. No. 2,192,899; Stull U.S. Pat. No. 2,230,658 and Gottheimer U.S. Pat. No. 2,254,280. These patents require special purpose plugs to cooperate with specially designed tracks to achieve random mounting of the male plug along the electrical power distribution track.

Twist on type motion for establishing electrical contact is shown in Stull and Gottheimer and also in Platz U.S. Pat. No. 3,081,442. Although Platz provides for receiving a conventional three-prong plug in an adaptor that can be randomly mounted along the power track, there is no suggestion in Platz of providing for the prongs on the plug to be electrically connected to conductors residing in opposite sides of the track as is true of the present invention. Herman, U.S. Pat. No. 3,299,391, shows a socket defining adaptor which can be provided on a track or base as a result of moving a lever on the adaptor that establishes contact between conductors in the base or track and the socket defining portions of the adaptor. However, Herman et al, like Platz, discussed previously does not show or suggest the concept of providing for releasably attaching the socket adaptor to the track in such a way as to provide for a cross over connection between the prongs for the plug and the conductors in the track.

Other patents related to power distribution systems have generally been devised for mounting lighting fixtures and the like to the track and locking the lighting fixture itself in the track by providing for a twisting motion of the adaptor usually through an angle of 90°. Examples of such twist lock capability of attaching lighting fixtures to a power distribution are found in Freemont U.S. Pat. No. 3,611,252; U.S. Pat. No. 3,529,274 issued to Roth, U.S. Pat. No. 3,503,032 also issued to Roth et al and U.S. Pat. No. 3,760,133 issued to Howard. The latter (U.S. Pat. No. 3,760,133) provides for a lever action to mount the adaptor to the track, and it also includes a switch in conjunction with the lighting fixture attachment. However, this Howard U.S. Pat. No. 3,760,133 and other patents mentioned do not show or suggest an adaptor capable of limited angular motion for attachment to the track, and also providing for the electrical cross over feature whereby the prongs of the male plug are electrically connected to conductors residing in opposite sides of the tracks from the prongs.

Finally, the present invention also provides for a convenient cover to be attached to the track so as to obtain added safety to the user in that the electrical conductors are rendered inaccessible. This safety feature further enhances the safety afforded by the electrical cross over feature of the adaptor itself.

SUMMARY OF THE INVENTION

The foregoing objects of the present invention are accomplished in a raceway which is adapted to be covered, and which raceway includes forwardly projecting legs that define a generally U-shaped cross section of the track or base. These projecting legs further define inwardly facing conductor slots, and elongated conductors are provided in these slots such that segments of each of the conductors are exposed along a side wall of each conductor slot for receiving uniquely configured portions of the socket defining adaptor. The U-shaped base further includes two secondary slots spaced from the conductor slots. The base further defines a central rib between the conductor slots and a grounding conductor is embedded in the central rib. The socket defining adaptor has a body portion with a rearwardly open cavity that is closed by a back plate, and the body portion defines spaced prong slots for receiving the spaced prongs of a conventional male electrical plug.

Fixed contacts are provided with laterally outwardly projecting conductor engagable end portions for engagement with the conductors in the conductor slots of the track when the back plate is in a locked position. These contacts are disposed rearwardly of the back plate and further include flag portions arranged forwardly of the back plate inside the cavity of the adaptor body portion.

Finally, U-shaped flexible contact elements are provided in the adaptor body portion, each U-shaped flexible contact element having one leg portion abutting one of the flag portions. Each U-shaped flexible contact element further includes a base extending laterally across the body portion cavity whereby second leg portions of these U-shaped flexible contact elements define conductive sockets for electrically engaging one of the male plug prongs. Each plug prong is thereby connected with an opposite conductor in the base, achieving the safety feature referred to in the preceding section.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE PREFERRED EMBODIMENT

Figure 1:
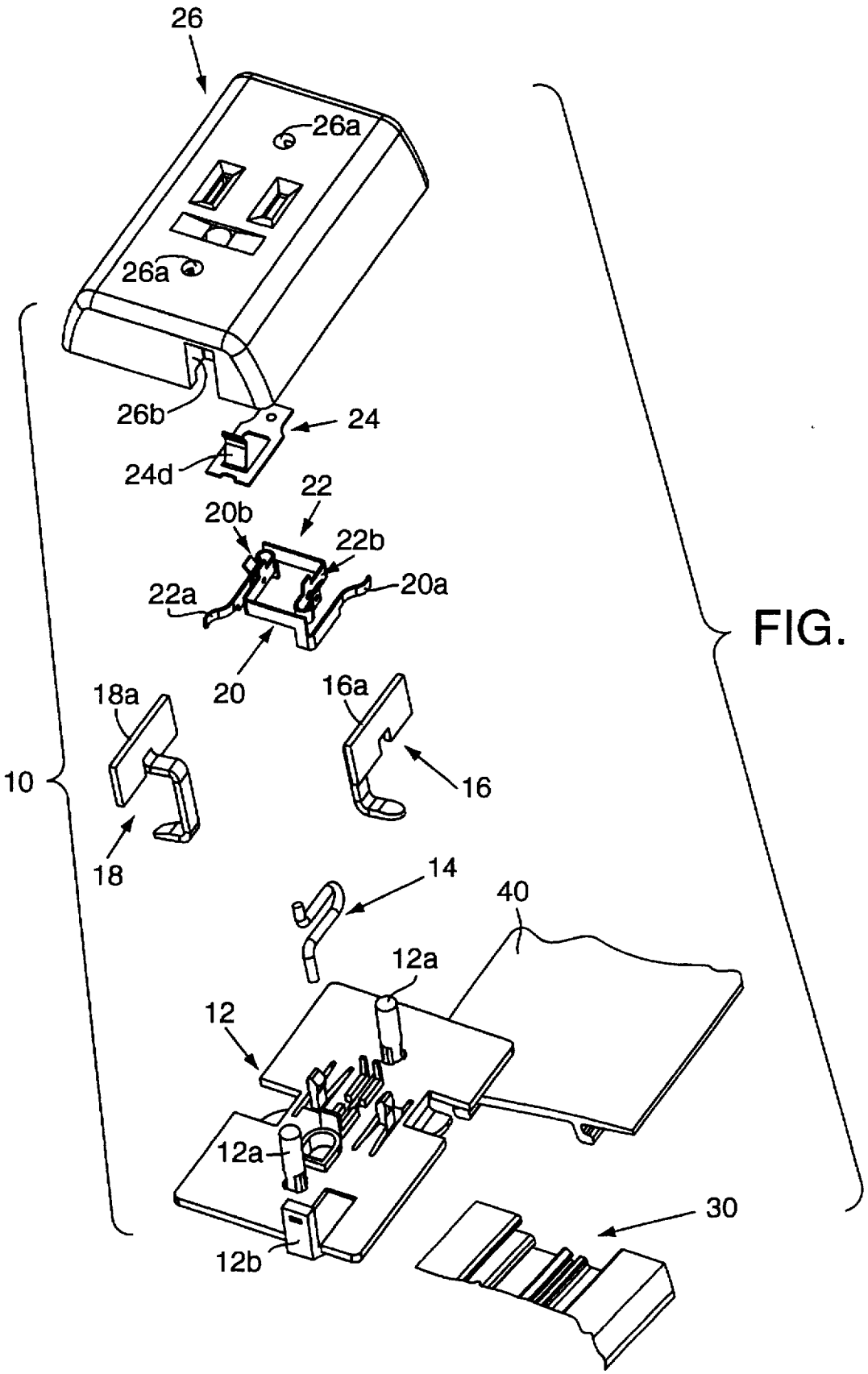
FIG. 1 is an exploded view, showing from a top side perspective, the components of an electrical socket adaptor constructed in accordance with the present invention, and the raceway track to which the adaptor is randomly mounted.

Turning now to the drawings in greater detail, FIG. 1 illustrates the various components of the present invention in exploded relationship relative to one another. A socket defining adaptor of the present invention is indicated generally at 10 and comprises a back plate 12 having a plurality of internal components including a generally U-shaped spring biasing means 14, a pair of fixed contacts 16 and 18, a pair of flexible contact elements 20 and 22, a grounding contact element 24, which cooperates with the spring 14 to provide electrical connection to an elongated ground conductor, and finally a body portion 26 which is adapted to be mounted to the back plate 12 by means of sockets **26*a* provided in the body portion that are adapted to receive studs 12*a* in the back plate 12**.

Figure 2:
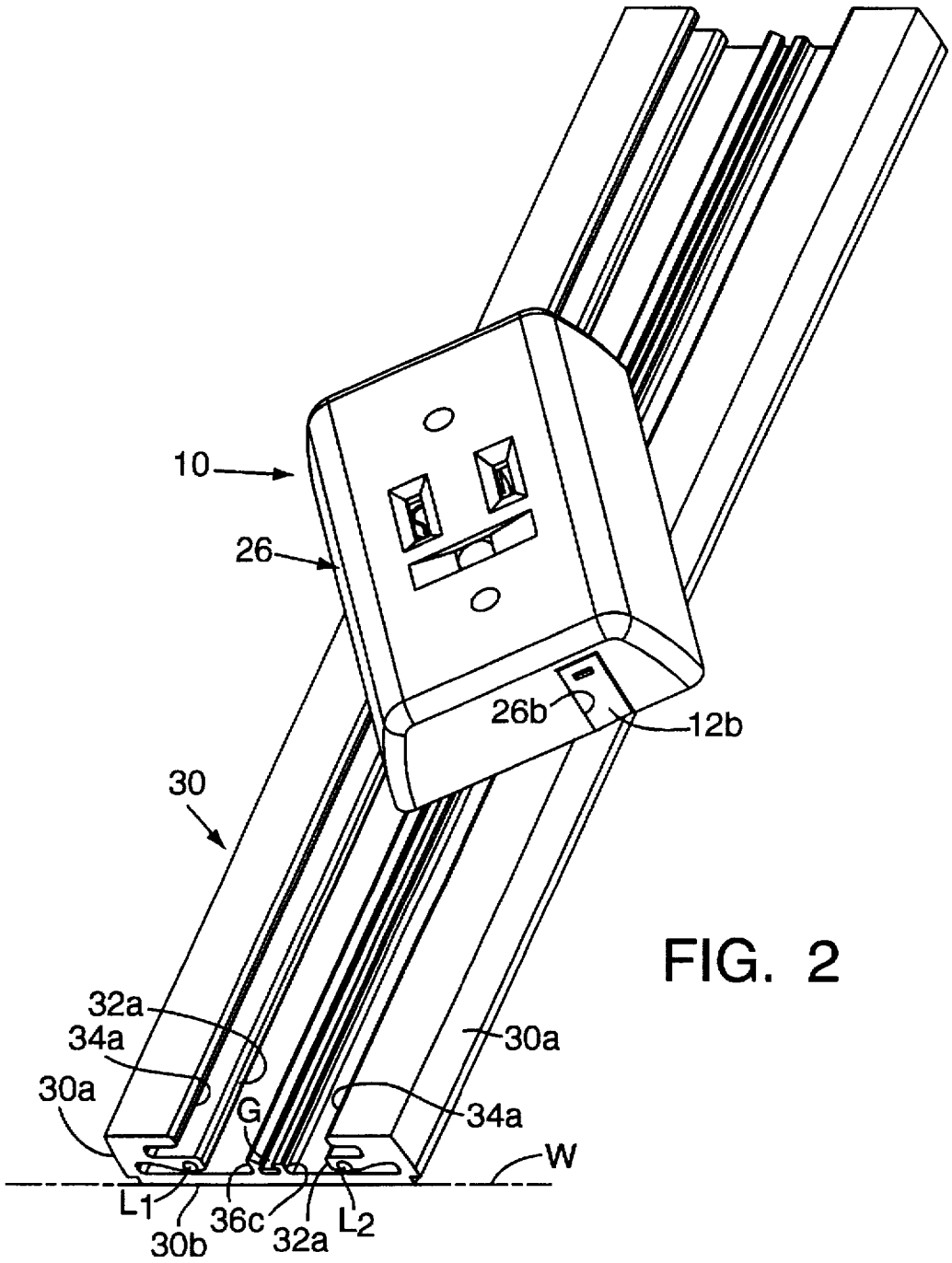
FIG. 2 is a more detailed view of a section of the track illustrated in FIG. 1 showing the socket adaptor in assembled relationship with its components in assembled relationship, and in a position prior to rotating the socket adaptor into alignment with the track.

FIG. 2 shows the socket defining adaptor in assembled configuration and in the process of being mounted on an extruded track or base 30. The adaptor 10 is provided in the position shown for it in FIG. 2 prior to rotating the adaptor into alignment with the track or base as suggested in FIG. 3. An upstanding tab **12*b* provided on the back plate of the adaptor is integrally connected to the back plate by a self-hinge and is received in a slot 26*b* defined by the body portion 26 so as to be manually movable from and to a locking position as the body portion is swung from the FIG. 2 position into the FIG. 3 position. This upstanding tab 12*b* allows manual manipulation of an integrally formed locking device located below the back plate in the space provided between the upstanding legs 30*a* of the track 30**.

Figure 3:
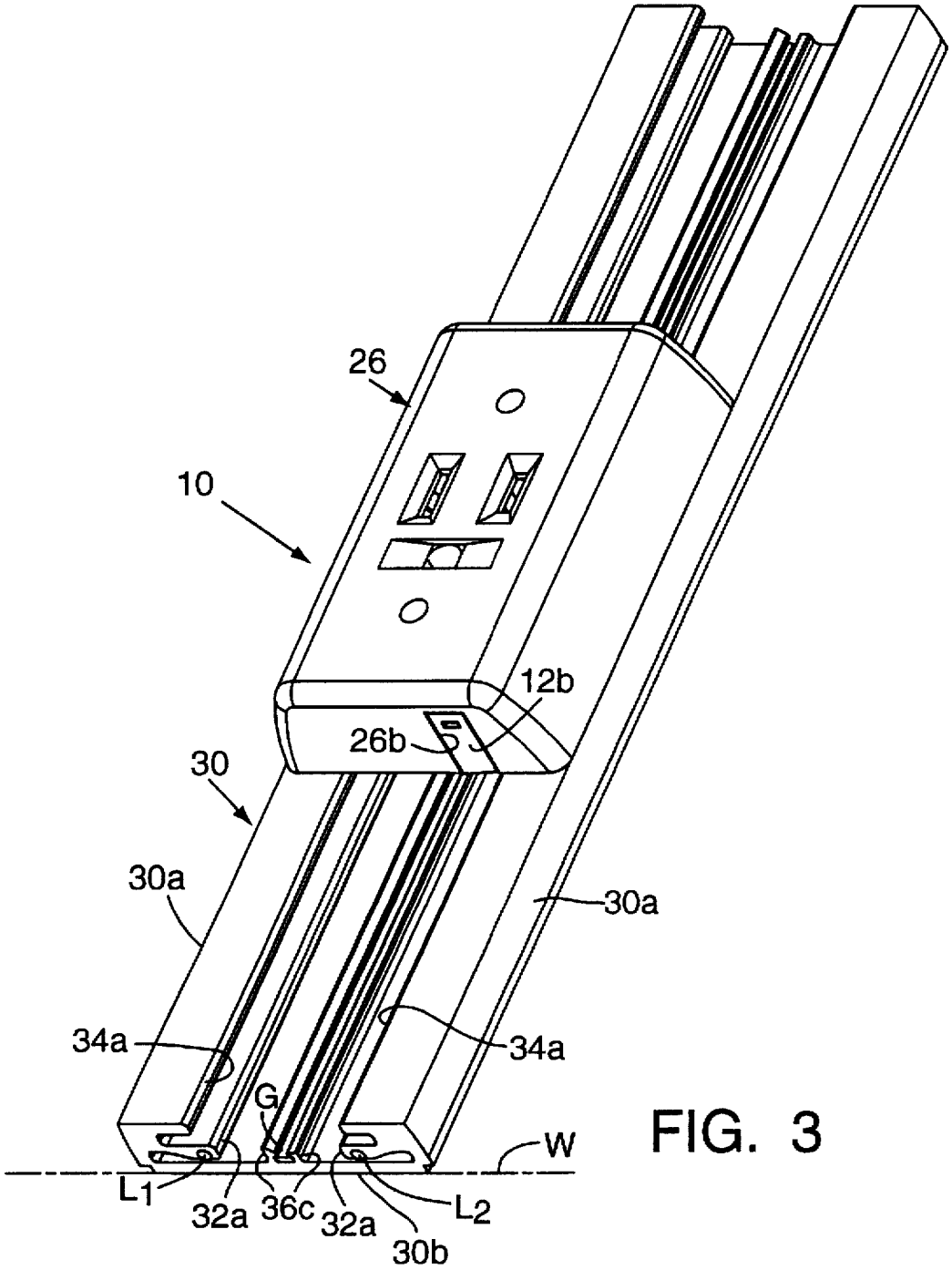
FIG. 3 is a perspective view of the track showing the assembled socket adaption assembled to track subsequent to rotating the socket adaptor into alignment with the track.

Turning now to a more detailed description of the track or base 30, FIGS. 2 and 3 show this component as generally U-shaped in configuration with a flat back or base **30*b*, which is adapted to be mounted by any convenient means, to a wall or other surface as indicated generally at W. The track is preferably fabricated in an extrusion process from a polymeric material, and that process preferably includes providing parallel conductors $L_1$, $L_2$ in the extruded material so that inwardly projection portions of the legs 32*a* cooperate with the back of the track 30*b*** to define conductor slots to be described in greater detail hereafter.

Figure 15:
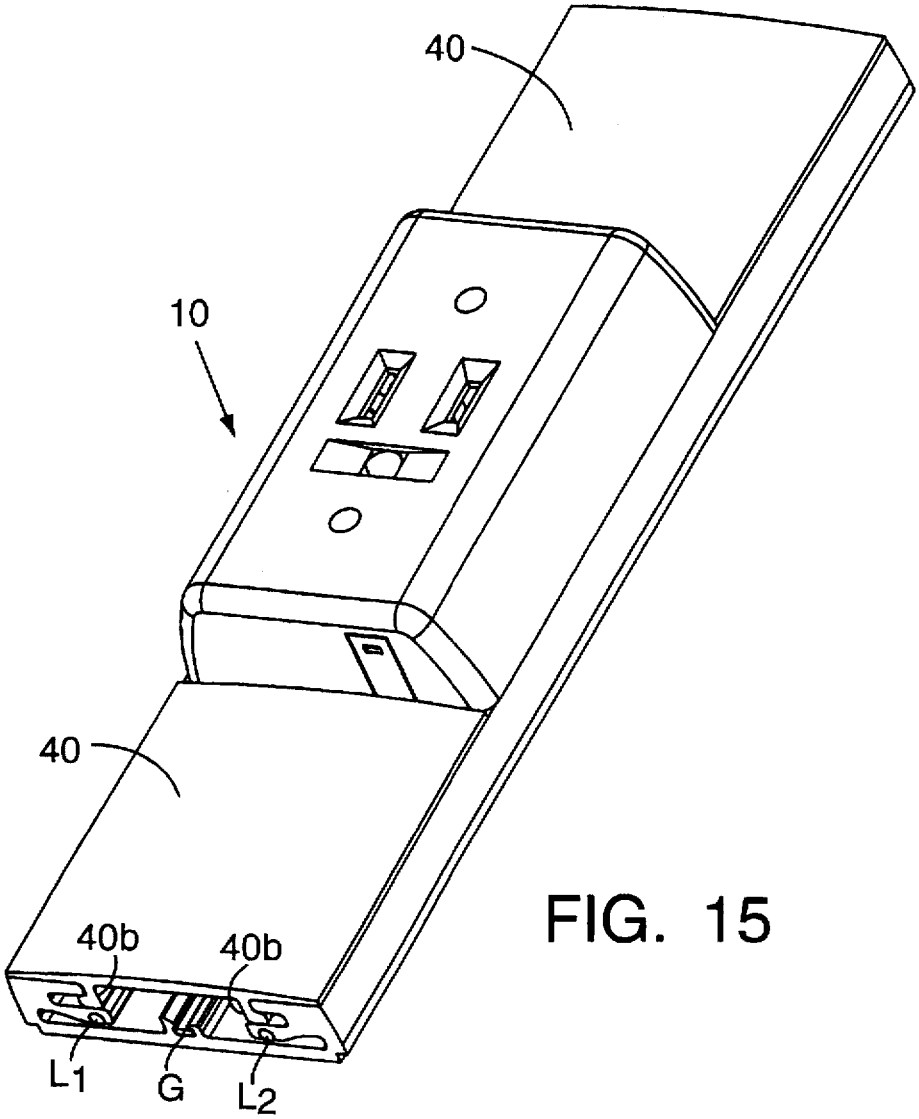
FIG. 15 is a top perspective view of the assembled components of the present invention.

The track or base further includes secondary slots spaced from each of these conductor slots and defined by inwardly projecting bottom portions **34*a* of the legs 30*a* in the extruded base. Thus, the base defines conductor slots for the conductors $L_1$ and $L_2$ and also defines secondary slots which are used to mechanically lock the socket defining adaptor 10 to the track. The secondary slots are also used to support cover segments of the raceway, after providing socket defining adaptors at spaced locations along the track as best shown in FIG. 15. Two such cover segments 40, 40 are illustrated in FIG. 15, one on either side of the socket defining adaptor 10. Each cover 40 includes rearwardly projecting ribs 40*b*, that in turn provide outwardly projecting feet, which feet are received in the secondary slots defined by the base. The cover 40 is sufficiently flexible so as to allow bending of the cover in the lateral direction for purposes of insertion of these feet in the ribs 40*b*** at assembly.

Still with reference to the track 30, the back portion **30*b* has a central rib that defines a recess in which a grounding conductor G is provided during the extrusion in much the same manner as is true of the conductors $L_1$ and $L_2$. This central rib portion is indicated generally at 36*c* and defines a generally V-shaped recess for guiding one end of the U-shaped spring biasing clip 14 into contact with the grounding conductor G as the socket defining adaptor is initially located in the FIG. 2 position. As the adaptor is rotated into the locked position of FIG. 3, such contact between grounding conductor G and spring clip 14** is maintained.

Figure 4:
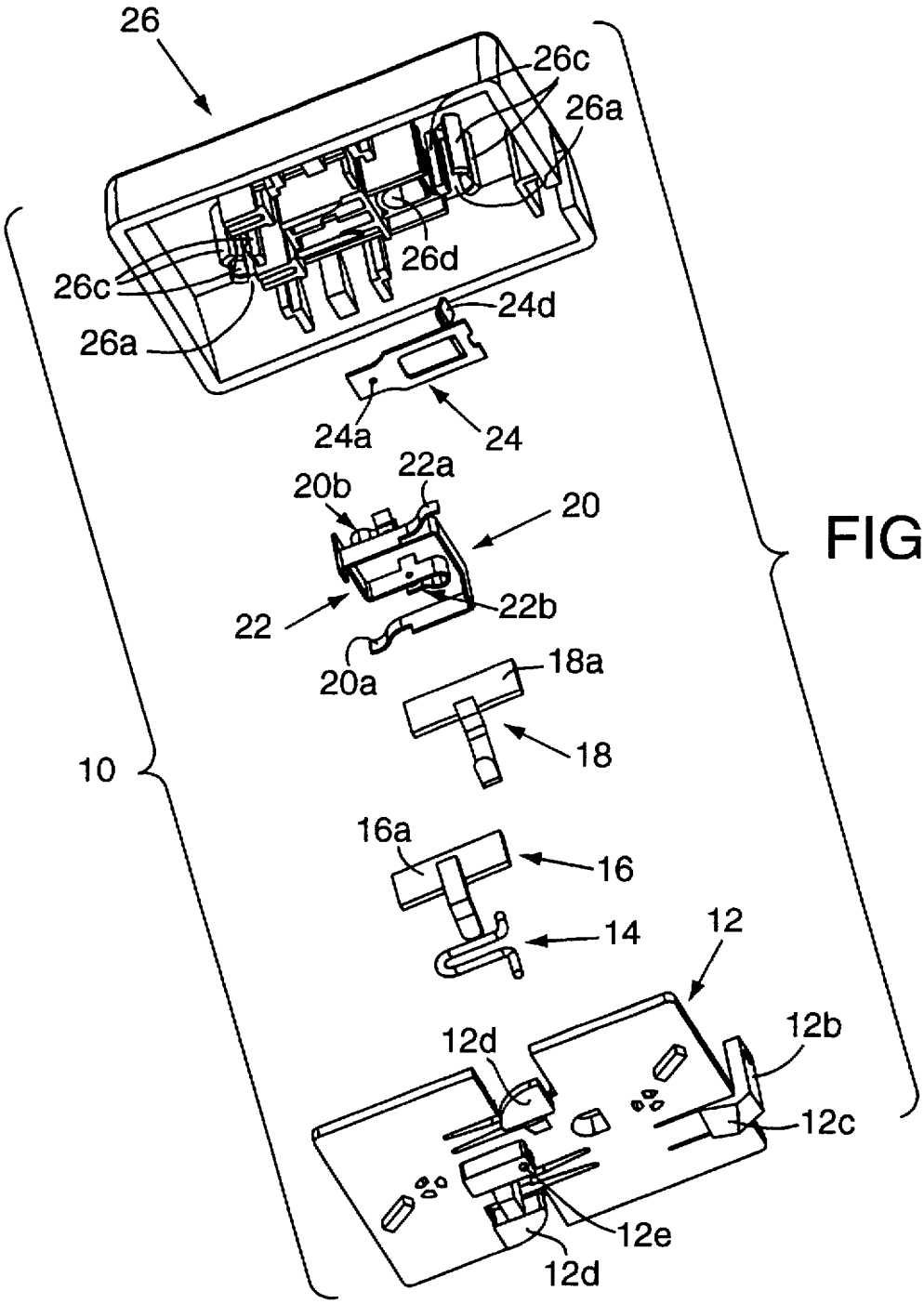
FIG. 4 is a perspective view showing the underside of the socket adaptor with the various components depicted in exploded relationship.

Turning now to FIG. 4, the back plate 12 is shown in exploded relationship to the body portion 26 with the underside of each being shown in contrast to the top portions of each as illustrated in FIG. 1. FIG. 4 also shows the various components provided within the socket defining adaptor, the U-shaped spring biasing clip being indicated generally at 14, the fixed contacts 16 and 18 and the flexible contacts 20 and 22 being shown as well. Finally, the grounding contact 24 is also shown in this view. The underside of the grounding clip is provided with a detent as indicated generally at **24*a* for receiving the end of the spring 14** which is opposite that end referred to previously for engaging the grounding conductor G.

Still with reference to FIG. 4, the underside of the back plate 12 is illustrated and the tab or handle which is used to flex this upstanding portion so as to achieve the above-described locking feature as a result of the abutment surface provide at **12*c* of this integrally formed component of the back plate 12. The back plate 12 further includes depending cams 12*d* that define curved outer portions, and that cooperate with the underside of the back plate 12 to define slots for receiving the inwardly projecting outer portions 34*a* of the extruded track described previously. These depending cams are themselves received in the secondary slots of the track as a result of positioning the socket defining adaptor as shown in FIG. 2 and thereby creating engagement between the lower end of the spring 14 and the grounding conductor G. An opening 12*c* in the back plate 12 is provided for receiving the lower end of the spring 14** for this purpose.

Still with reference to FIG. 4, the underside of the body portion 26 of the socket defining adaptor defines openings **26*a* for receiving the studs 12*a* on the back plate 12. These openings are more particularly defined by means of three integrally formed depending legs 26*c*. A recess 26*d* in the underside of the body portion 26 is provided for receiving a tang 24*d* on the grounding contact element 24. This tang is formed by providing a cut out in the grounding contact element 24 and bending the tang into position. As so constructed and arranged, the slot 26*d* cooperates with the tang 24*d*** to define a socket for receiving the grounding stud of a conventional male plug (not shown).

Figure 5:
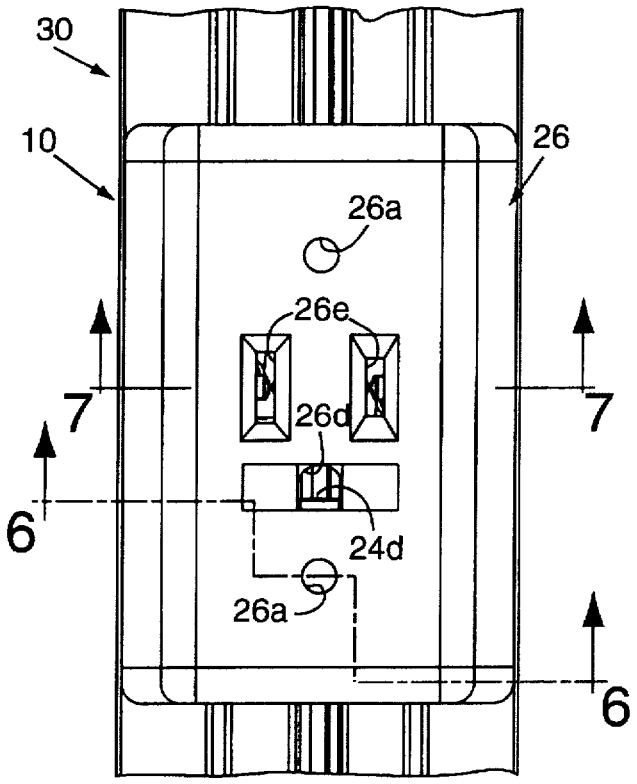
FIG. 5 is a top plan view of the socket adaptor provided in a similar relationship with the underlying track.
Figure 6:
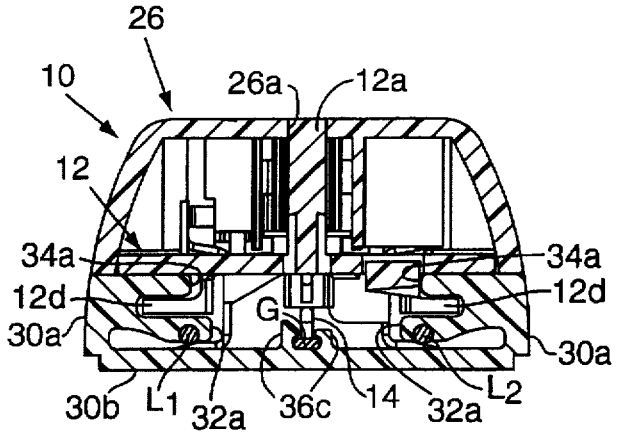
FIG. 6 is a sectional view taken on the line 6.6 of FIG. 5.

Turning next to FIG. 5, a plan view of the socket is there shown as defining slots for receiving the various prongs of a typical male plug, the neutral and hot plug prongs being received in generally rectangular openings **26*e*, and the grounding stud being received in the above-mentioned opening 26*d*. With respect to the grounding stud opening, FIG. 5 also shows an end portion of the tang 24*d* of the grounding contact element 24. FIG. 5 also shows opposed contacts provided in the openings 26*a*** for receiving the hot and neutral prongs of the male plug.

Figure 7:
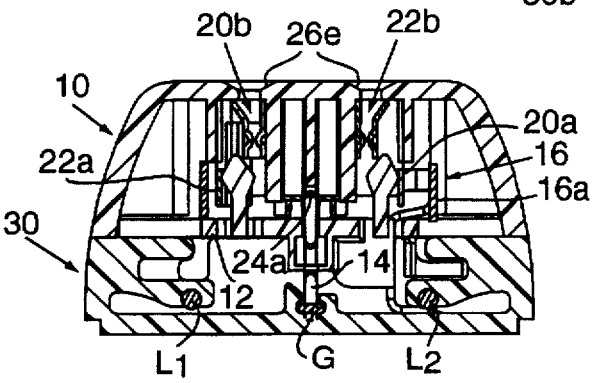
FIG. 7 is a sectional view taken on the line 7.7 of FIG. 5.
Figure 8:
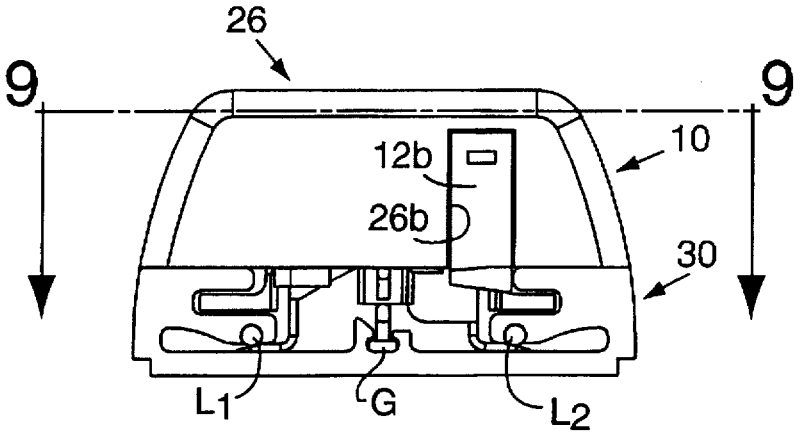
FIG. 8 is a sectional view taken through the track and depicting the lockable end portion of the socket adaptor.

The cooperation between the various components in the socket defining adaptor will now be described in greater detail to illustrate the electrical path provided between the conductors $L_1$ and $L_2$, and these contacts associated with the male plug prong openings 26e. As best shown in FIG. 7, and with specific reference to the conductor $L_2$ in the track or base 30, it can be seen that the fixed electrical contacts 16 has an outwardly projecting portion that is received in the conductor slot provided in the base so as to create electrical contact between it and this conductor $L_2$ once the socket defining adaptor has been rotated into the position shown for it in FIG. 3. This fixed contact 16 has an upper flag portion that is shown in FIGS. 1–4, 16a which is adapted to engage a cantilevered free end portion 20a of one of the two flexible contact elements 20. This flexible contact element is of general U-shaped and provides a path for the electricity associated with conductor $L_2$ so as to feed that electricity to a slot 26b located oppositely with respect to that conductor $L_2$. An opposite end of the U-shaped flexible contact element indicated generally at 20b defines a relatively movable contact portion that is provided in the path of plug prong which is received in that opening.

Figure 9:
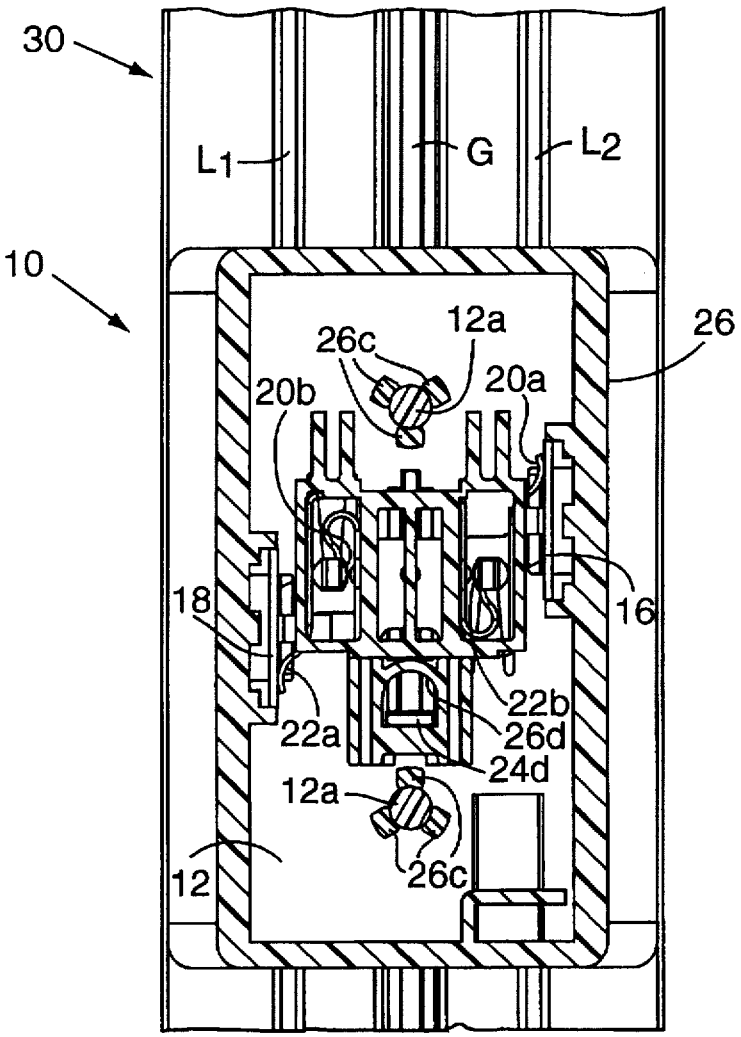
FIG. 9 is a sectional view taken on the line 9.9 of FIG. 8.

The opposite conductor $L_1$ is electrically connected to the other plug prong socket as a result of the second fixed contact 18 and its associated U-shaped contact element 22. Thus, and with specific reference to FIG. 9, it will be apparent that the right hand contact 20a associated with the right hand prong slot of the adaptor is electrically connected to the conductor $L_1$, whereas the left hand contact 22a is connected to the opposite conductor $L_2$ in the base or track. Thus, when an electrical plug is inserted into the socket defining adaptor, the right side blade activates the left contact and vice versa. No electricity flows when only one blade is inserted in either side. As the blade or prong is inserted, it physically moves the free arm against an opposed stationary contact in that slot so as to afford satisfactory electrical contact between the plug prong and the sockets in the socket defining adaptor.

Figure 10:
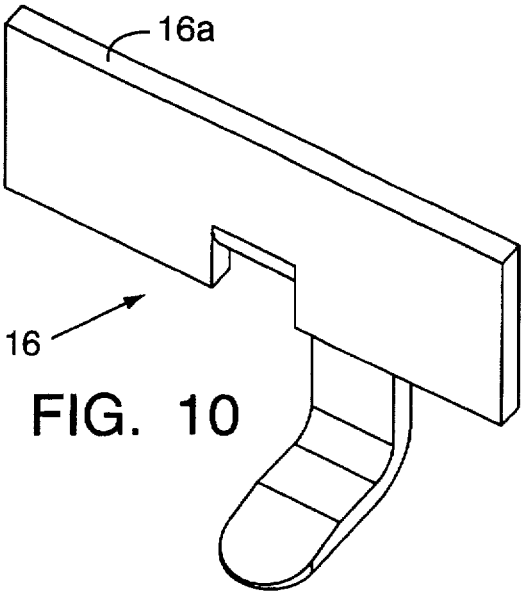
FIG. 10 is a perspective view of one of the conductor engaging contacts.
Figure 11:
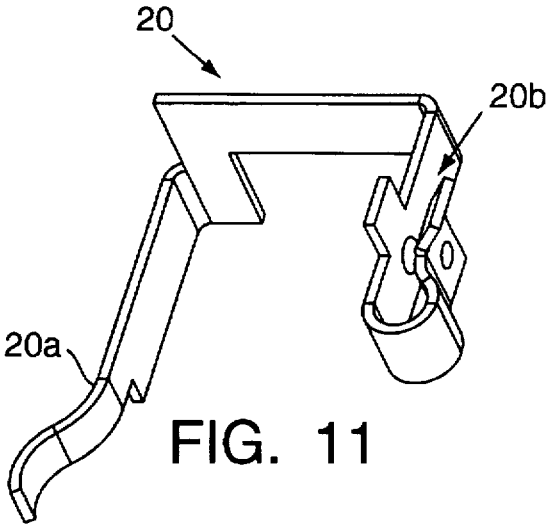
FIG. 11 is a perspective view of one of the flexible contact elements.
Figure 12:
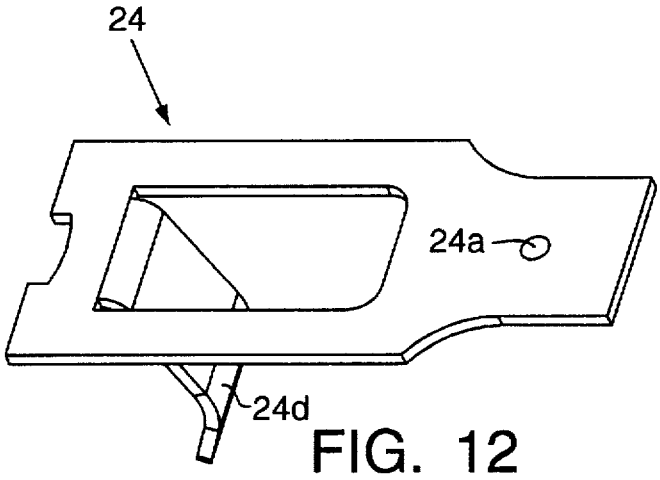
FIG. 12 is a perspective view of the center contact associated with the ground wire in the raceway base or track.
Figure 13:
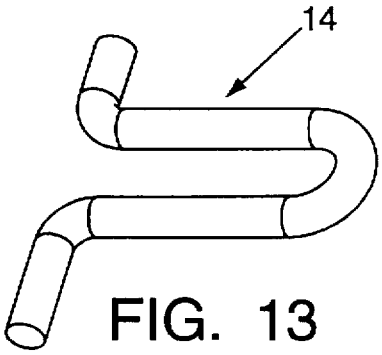
FIG. 13 is a perspective view of the spring wire biasing means provided to make contact between the contact of FIG. 11 and the ground wire in the track.
Figure 14:
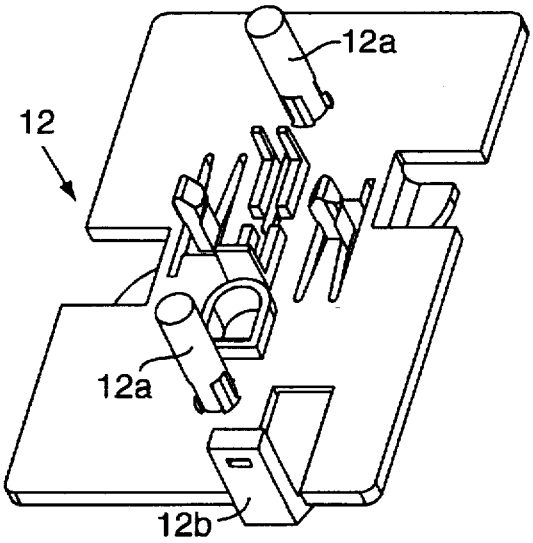
FIG. 14 is a top perspective view of the back plate.

FIG. 10 illustrates the configuration of the fixed contact 16 in greater detail, and FIG. 11 shows the U-shaped flexible contact element 20 and more particularly its flexible portion 20a as well as the opposed socket defining 20b.

We claim:

1. A raceway comprising in combination:

a continuous raceway base of extruded polymeric material and including forwardly projecting legs defining a generally U-shaped cross section, said projecting legs further defining inwardly facing open conductor slots, elongated conductors ($L_1$ and $L_2$) provided in said slots such that continuous segments of each of said conductors are exposed along a side wall of each such conductor slot, each leg of the U-shaped base further defining a secondary slot spaced from each of said conductor slots, and said base having a central rib provided between said facing conductor slots, and a grounding conductor (G) embedded in said central rib and having a forwardly exposed grounding conductor segment;

a socket defining adaptor including a back plate with opposed depending cams adapted for insertion into said secondary slots of said base as a result of rotating said back plate through a limited angular displacement between a first position where said cams fit between said legs of said U-shaped base and a second position wherein said cams are inserted into said secondary slots;

said socket defining adaptor further including a body portion having a rearwardly open cavity that is adapted to be closed by said back plate, said body portion having spaced prong slots for receiving the spaced prongs of a conventional male electrical plug;

fixed contacts having laterally outwardly projecting conductor engagable end portions that engage said conductors in said conductor base slots when said back plate is in said second position, said fixed contacts being disposed rearwardly of said back plate, and said fixed contacts further including generally flat flag portions arranged forwardly of said back plate inside said cavity of said adaptor body portion, U-shaped flexible contact elements, each U-shaped flexible contact element having one leg portion abutting one of said flag portions, each said U-shaped flexible contact element further including a base portion extending laterally across said adaptor body portion cavity, and each said U-shaped flexible contact member further including a second leg portion defining a conductive socket for electrically connecting one of the male plug prongs to a conductor in said base, each said conductor provided generally opposite its associated socket.

2. The raceway of claim 1 further characterized by an extruded polymeric cover segment for said raceway base, said cover segment having laterally spaced rearwardly projecting ribs, and said ribs having out-turned foot portions adapted to fit into said secondary slots as a result of flexing said cover segment whereby said cover segment is releasably secured to said raceway base covering said exposed conductor segments and providing a unitary raceway appearance.

3. The raceway of claim 1 further characterized by means defined in part by said back plate and in part by said body portion to secure said back plate to said body portion, and manually releasable handle means defined by said back plate and defining an abutment stop for engaging at least one of said legs of said raceway base to releasably hold said socket defining adaptor in alignment with said raceway base.

4. The raceway of claim 1 further characterized by a conductive grounding clip having an upwardly projecting portion defining a grounding socket for the grounding stud of a male plug, and a spring element acting between said grounding clip and said grounding conductor, said spring element providing a pivot point for said socket defining adaptor when in contact with said grounding conductor during said limited angular displacement thereof.

5. The raceway of claim 1 further characterized by integrally formed lands defined in part by said body portion and in part by said back plate for supporting said fixed contacts and said U-shaped flexible contact elements in said cavity of said body portion.

* * * * *

UNITED STATES PATENT AND TRADEMARK OFFICE

CERTIFICATE OF CORRECTION

PATENT NO. : 5,759,051

DATED : June 2, 1998

INVENTOR(S) : Cancellieri and Rogers

It is certified that error appears in the above-indentified patent and that said Letters Patent is hereby corrected as shown below:

Column 2, Line 63, delete "a sectional view taken through the track and" and substitute --an end view--.
Column 4, Line 3, delete "ribs 40b" and substitute --secondary slots--.
Column 4, Line 44, delete "12c" and substitute --12e--.
Column 4, Line 66, delete "26a" and substitute --26e--.
Column 5, Line 7, delete "contacts" and substitute --contact--.
Column 5, Line 18, delete "26b" and substitute --26e--.
Column 5, Line 21, insert --a-- prior to "plug".
Column 5, Line 42, insert --portion-- after "defining".

Signed and Sealed this

Fifteenth Day of September, 1998

Bruce Lehman

*Attest:*

BRUCE LEHMAN

*Attesting Officer*

*Commissioner of Patents and Trademarks*